United States Patent [19]

Hughes

[11] Patent Number: 4,706,764

[45] Date of Patent: Nov. 17, 1987

[54] TWO PIECE DOWN HOLE DRILL CHUCK

[75] Inventor: Robert W. Hughes, Easton, Pa.

[73] Assignee: Ingersoll-Rand Company, Woodcliff Lake, N.J.

[21] Appl. No.: 891,560

[22] Filed: Aug. 1, 1986

[51] Int. Cl.[4] ..... E21B 17/10; E21B 10/36

[52] U.S. Cl. ..... 175/320; 175/415

[58] Field of Search ..... 175/320, 321, 327, 409, 175/414, 415, 417–420, 293, 294; 173/78, 80, 132, 133; 279/19.6, 19.7, 19.3, 19.5

[56] References Cited

U.S. PATENT DOCUMENTS

| | | | |
|---|---|---|---|
| 3,193,024 | 7/1965 | Cleary | 173/78 |
| 3,621,191 | 10/1971 | Martini | 175/320 X |
| 3,991,834 | 11/1976 | Curington | 173/73 |

FOREIGN PATENT DOCUMENTS

| | | | |
|---|---|---|---|
| 1173857 | 7/1964 | Fed. Rep. of Germany | 279/19.6 |
| 202609 | 3/1966 | Sweden | 175/320 |
| 176538 | 12/1965 | U.S.S.R. | 175/293 |
| 347428 | 8/1972 | U.S.S.R. | 175/321 |

*Primary Examiner*—James A. Leppink
*Assistant Examiner*—Hoang C. Dang
*Attorney, Agent, or Firm*—Walter C. Vliet

[57] ABSTRACT

Disclosed is a two piece drill chuck for use with down-hole drills and the like. The new chuck features a replaceable wear collar portion which permits optimum material selection and heat treatment for each part of the chuck thereby extending its useful life. By expanding the wear collar slightly beyond the drill diameter and extending it axially rearward an improved measure of protection is also afforded to the drill casing.

3 Claims, 4 Drawing Figures

TWO PIECE DOWN HOLE DRILL CHUCK

BACKGROUND OF THE INVENTION

Downhole drills suffer considerable exposure to erosive conditions in that air or other fluid entrained rock solids are passed along the outside of the drill on their way out of the drill hole. Erosive damage to the drill is a common cause of drill failure. Drill chucks which hold the working drill bit are particularly vulnerable to such damage in that they are located in close proximity to the transition zone between the drill face, where the rock is cut, and the walls of the drilled hole where air flow is most erratic.

The chucks for downhole drills have historically been of one (1) piece design. The material selection has been a compromise between the mechanical requirements of the spline/thread area and the erosive resistance requirement of the collar.

OBJECT OF THE INVENTION

The object of this invention is to provide a two piece downhole drill chuck which will:

1. Permit material selection for optimum properties for the highly machined close tolerances (i.e., threads, splines, bearing bore, registers, concentricities, etc.) portion of the chuck. In most cases this portion of the chuck is still serviceable when the chuck is discarded because of excessive erosive wear in the collar portion. Thus, this position of the chuck can support a series of wearable replaceable collar portions.

2. Provide a low cost replaceable collar portion that requires minimal machining. The material and heat treatment can be selected to provide economic optimum properties to resist the severe erosive abrasion to which the chuck collar is subjected.

Thus, the prime objective is to provide an economic chuck in which a single relatively expensive, highly machined chuck portion can support a succession of low cost chuck collars that are subject to high rates of wear.

These and other objects are obtained in a downhole drill chuck comprising: a mounting chuck means for securing a drill bit to a downhole drill; and a chuck wear collar concentric about an outside portion of the mounting chuck means and mounted thereon for protection thereof.

DESCRIPTION OF THE PREFERRED EMBODIMENT

Figure 1:
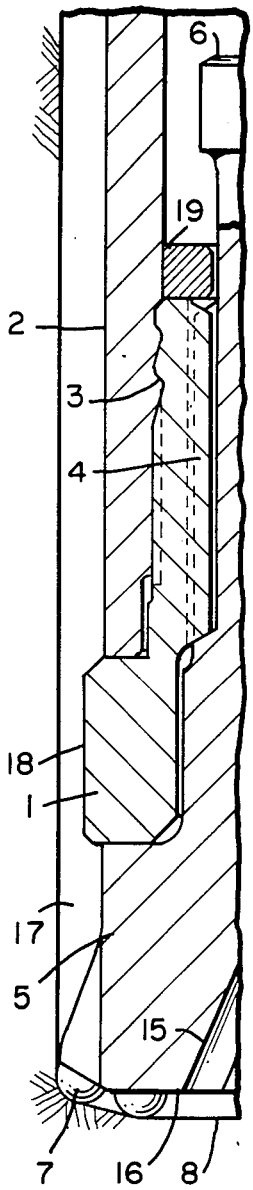
FIG. 1 PRIOR ART
FIG. 1 shows a half longitudinal section of a conventional downhole drill chuck.

FIG. 1 shows a downhole drill according to the prior art. The drill chuck (1) is shown in the conventional one piece construction. As one skilled in the art must appreciate, this is a highly machined part having threads and splines with both internal and external tolerances. Materials must be chosen for a compromise of wear, toughness and machinability.

Figure 2:
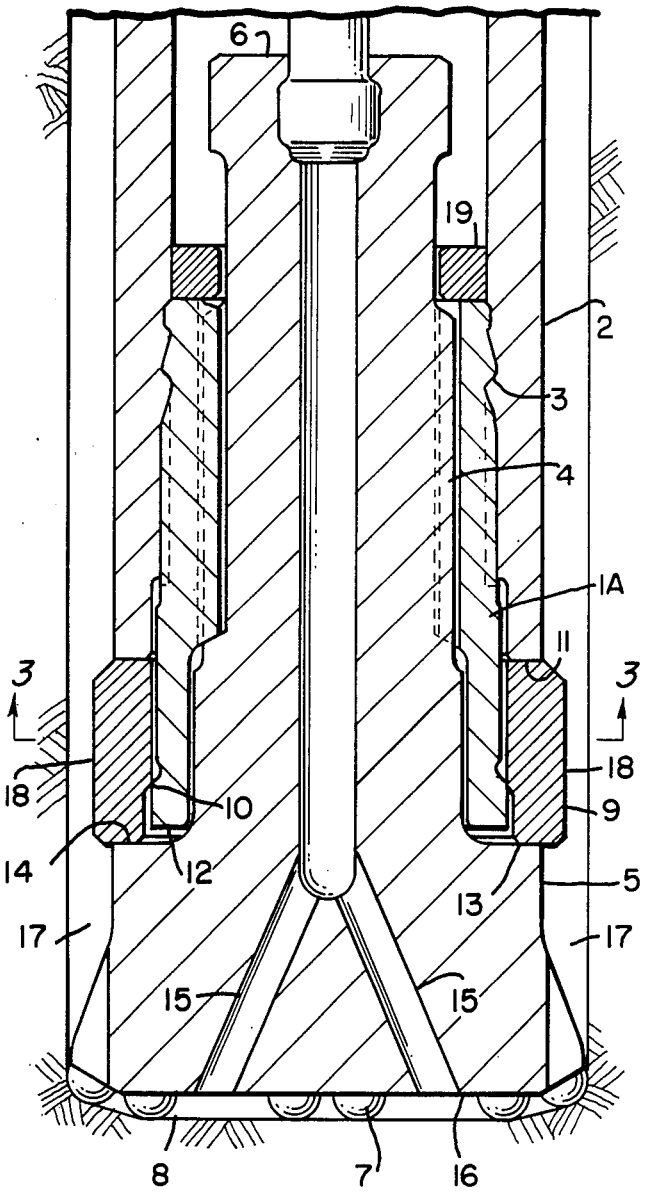
FIG. 2 shows a longitudinal section of a downhole drill chuck according to the present invention.

FIG. 2 shows a two piece drill chuck according to the present invention. The chuck portion (1A) on a downhole drill serves to transfer the rotational torque (from a source not shown) of the casing (2) thru the threads (3) and the splines (4) to the downhole bit (5). The split bit retaining ring (19) retains the bit in the downhole drill during the retract operation. The splines (4) permit the axial percussive motion of the bit (5) initiated by the successive percussive impact of the piston (not shown) on the struck face (6) to be transmitted to the tungsten carbide inserts (7) in contact with the rock (8) and thus accomplish the desired drilling. The chuck collar (9) portion is assembled on chuck portion (1*a*) prior to engaging thread (3) and is clamped between the shoulder (10) of chuck (1) and the face (11) of casing (2). Face (12) of chuck portion (1) is recessed so that face (13) of chuck collar (9) is in contact with the back face of bit head (14) of bit (5). Thus, the rebound energy of bit (5) is transmitted from bit head (14) thru face (13) of chuck collar (9) then thru face (11) of casing (2) and then thru system support components (not shown). The compressed air used to provide the percussive energy to the piston (not shown) is exhausted thru conduit (15) across the face (16) of the bit head (14) where it picks up rock cuttings and exhausts them thru annulus (17) and then to the surface. The high velocity of the exhaust air/rock cutting mixture (resulting from high air flows associated with high pressure operation) in annulus (17) can cause high rates of erosive abrasive damage on surface (18) of chuck collar (9) and thus result in early discard.

Figure 3:
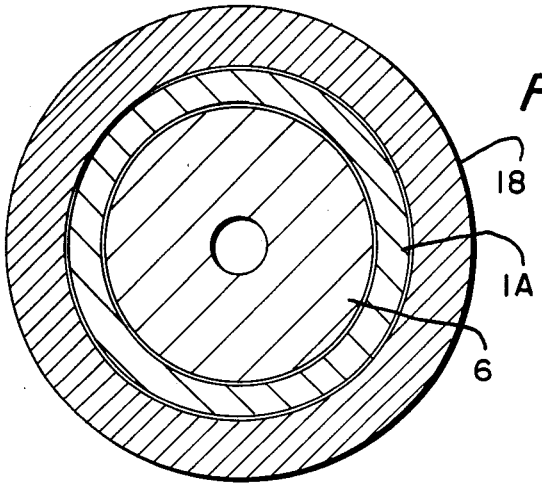
FIG. 3 is a cross section of the downhole drill according to the present invention taken at section 3—3 of FIG. 2.

FIG. 3 shows the cross section of the drill chuck according to the present invention.

Thus, the two piece chuck permits the replacement of a succession of low cost high wear rate chuck collar (9) while retaining a single relatively expensive highly machined low wear rate chuck portion (1A).

Figure 4:
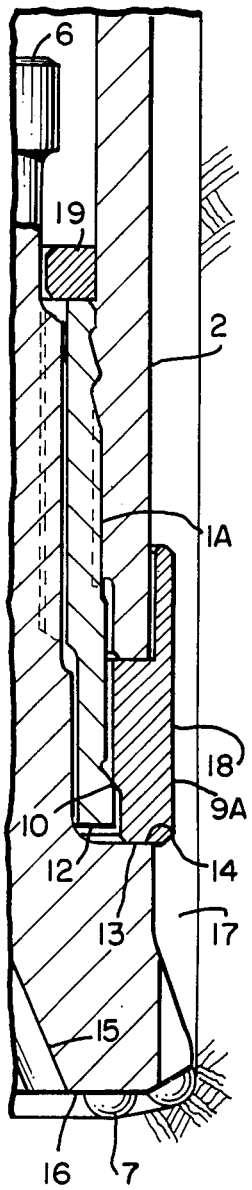
FIG. 4 shows a half longitudinal section of an alternative embodiment of the drill chuck according to the present invention.

FIG. 4 shows an alternative embodiment of the present invention wherein the chuck collar (9A) is modified to extend longitudinally rearward from the drill face to extend over the casing (2) and thereby effect a measure of protection for the end of the casing which is also subject to erosive wear in the prior art. The feature of the chuck skirt extending rearward over the casing (2) is impossible to economically machine in a one piece chuck and thus is a feature benefit of the two piece design.

In this embodiment, the wear resistant material of the chuck collar performs a dual function in that it permits not only longer life of its chuck but also extends the life of the drill casing.

Having now described my invention in terms of a preferred embodiment, I do not wish to be limited in the scope of my invention except as claimed.

I claim:

1. A two piece drill chuck for a downhole drill of the type comprising:

a cylindrical casing supported on a drill string for driving support therefrom;

a drill bit partly surrounded by the extending downwardly from said casing, said drill bit being of the type where drilling fluid is supplied through a central bore in said drill bit and exits the drill bit and drill hole about the peripheral outside surface of said drill bit and said casing;

the improvement comprising:

a mounting chuck means of hollow cylindrical form for securing said drill bit to a downhole drill;

said chuck mounting means being interspaced between said casing and said drill bit and being in driving engagement with said casing and said drill bit, said mounting chuck means having a lower portion extending downwardly beyond the lower end of the casing; and a chuck wear collar of hollow cylindrical form concentric about and covering the entire otherwise exposed lower portion of said mounting chuck means, said chuck wear collar having an upwardly facing surface in engagement with said casing and a downwardly facing surface in engagement with the drill bit.

2. The two piece drill chuck according to claim 1 wherein: said mounting chuck means is made of a tough, machinable material and said wear collar is made of erosion resistant material.

3. The two piece drill chuck according to claim 1 wherein: said wear collar extends upwardly over the casing of the downhole drill to effect erosion protection of said casing.

* * * * *